US007753690B2

(12) United States Patent
Maruyama et al.

(10) Patent No.: US 7,753,690 B2
(45) Date of Patent: Jul. 13, 2010

(54) L-SHAPED COAXIAL CONNECTOR AND THE MANUFACTURING METHOD

(75) Inventors: Yuichi Maruyama, Kyoto-fu (JP); Susumu Hashimoto, Osaka-fu (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 12/563,787

(22) Filed: Sep. 21, 2009

(65) Prior Publication Data

US 2010/0081320 A1 Apr. 1, 2010

(30) Foreign Application Priority Data

Sep. 26, 2008 (JP) ..... 2008-247347

(51) Int. Cl.
*H01R 12/00* (2006.01)

(52) U.S. Cl. ..... 439/63; 439/582; 439/881

(58) Field of Classification Search ..... 439/63, 439/581, 582, 881, 902
See application file for complete search history.

(56) References Cited

U.S. PATENT DOCUMENTS 4,708,414 A * 11/1987 Lam ..... 439/582

6,739,907 B2 * 5/2004 Kuroda et al. ..... 439/582

FOREIGN PATENT DOCUMENTS

JP 5-046230 U 12/1993

* cited by examiner

*Primary Examiner*—Tho D Ta
(74) *Attorney, Agent, or Firm*—Studebaker & Brackett PC; Tim L. Brackett, Jr.

(57) ABSTRACT

An L-shaped coaxial connector manufactured with a relatively small number of processes and a method of manufacturing the L-shaped coaxial connector are provided. A housing of the L-shaped coaxial connector is connected to an outer conductor. A bushing is attached to the housing. A socket is attached to the bushing, and the socket is insulated from the housing through the bushing. The housing includes a crimping portion. The crimping portion is bendable, in a state in which a part of the bushing is exposed, so that the crimping portion is in pressed contact with the bushing. The bushing is in pressed contact with the insulating film with a force from the crimping portion. The socket pierces the insulating film with a force from the bushing to connect to a center conductor of a coaxial cable.

20 Claims, 19 Drawing Sheets

(a)

(b)

(a)

(b)

(c)

PRIOR ART

L-SHAPED COAXIAL CONNECTOR AND THE MANUFACTURING METHOD

CROSS REFERENCE TO RELATED APPLICATIONS

The present application claims priority to Japanese Patent Application No. 2008-247347, filed Sep. 26, 2008, the entire contents of each of the application being incorporated herein by reference in its entirety.

BACKGROUND OF THE INVENTION

1. Field of the Invention

The present invention relates to an L-shaped coaxial connector and a method of manufacturing the L-shaped coaxial connector. In particular, the present invention relates to an L-shaped coaxial connector that may be connected to and disconnected from a receptacle having a center conductor and an external conductor, and to a method of manufacturing the L-shaped coaxial connector.

2. Description of the Related Art

Existing L-shaped coaxial connectors include, for example, an L-shaped coaxial plug connector, such as described in Japanese Examined Utility Model Registration Application Publication No. 05-46230. FIG. 19 is an exploded perspective view of an L-shaped coaxial plug connector 210 of the prior art.

As shown in FIG. 19, the L-shaped coaxial plug connector 210 is attached to an end of a coaxial cable 220, and can be connected to and disconnected from a receptacle (not shown). As shown in FIG. 19, the L-shaped coaxial plug connector 210 includes a case 212, an insulator 214, and a contact 216.

The case 212 is connected to an outer conductor 222 of the coaxial cable 220. The case 212 includes a body 217 and a cable gripper 218. The body 217 contains the insulator 214 and the contact 216. When the L-shaped coaxial plug connector 210 is connected to a receptacle (not shown), the body 217 is connected to an external conductor of the receptacle. The cable gripper 218 is crimped so as to hold the outer conductor 222.

The insulator 214 is attached to the inside of the body 217, and insulates the case 212 from the contact 216. The contact 216 is attached to the insulator 214, and connected to a center conductor 224 of the coaxial cable 220. When the L-shaped coaxial plug connector 210 is connected to a receptacle (not shown), the contact 216 is connected to an inner conductor of the receptacle.

However, the L-shaped coaxial plug connector 210 has a problem in that a large number of processes are necessary to manufacture the L-shaped coaxial plug connector 210. Specifically, to manufacture the L-shaped coaxial plug connector 210, the cable gripper 218 is crimped so as to fix the coaxial cable 220 to the case 212, and the contact 216 is pressed into the insulator 214. At this time, the contact 216 breaks through an insulating film 223 of the coaxial cable 220 and contacts the center conductor 224. Thus, with the L-shaped coaxial plug connector 210, it is necessary to separately perform a process of crimping the cable gripper 218 and a process of connecting the contact 216 to the center conductor 224.

SUMMARY OF THE INVENTION

Accordingly, it is an object of the present invention to provide an L-shaped coaxial connector that can be manufactured with a fewer number of processes, and a method of manufacturing the L-shaped coaxial connector.

According to preferred embodiments of the present invention, an L-shaped coaxial connector can be connected to and disconnected from a receptacle including a first center conductor and an external conductor, and the L-shaped coaxial connector includes a coaxial cable having an outer conductor and a second center conductor insulated from the outer conductor by an insulating film disposed therebetween, a housing in contact with the external conductor and connected to the outer conductor, a bushing attached to the housing, and a socket attached to the bushing and insulated from the housing through the bushing, the socket being in contact with the first center conductor.

The housing includes a crimping portion in pressed contact with the bushing when the crimping portion bent when the connector is assembled. In the state in which the crimp is bent and in contact with the bushing, a part of the bushing that is not in contact with the crimping portion is exposed. The bushing is in pressed contact with the insulating film with a force applied from the crimping portion. The socket includes an attaching portion in pressed contact with the insulating film with a force applied from the bushing, the attaching portion breaking the insulating film so as to be connected to the second center conductor.

According to preferred embodiments of the present invention, a method of manufacturing the L-shaped coaxial connector includes the steps of attaching the bushing to the housing, attaching the socket to the bushing, placing the coaxial cable on the attaching portion, and connecting the attaching portion to the second center conductor by bending the crimping portion, in the state in which the part of the bushing is exposed.

The present invention provides an L-shaped coaxial connector that can be manufactured with a fewer number of processes, and a method of manufacturing the L-shaped coaxial connector.

Other features, elements, characteristics and advantages of the present invention will become more apparent from the following detailed description of preferred embodiments of the present invention with reference to the attached drawings.

DESCRIPTION OF THE PREFERRED EMBODIMENTS

Hereinafter, an L-shaped coaxial connector according to an embodiment of the present invention and a method of manufacturing the L-shaped coaxial connector are described with reference to the drawings.

Figure 1:
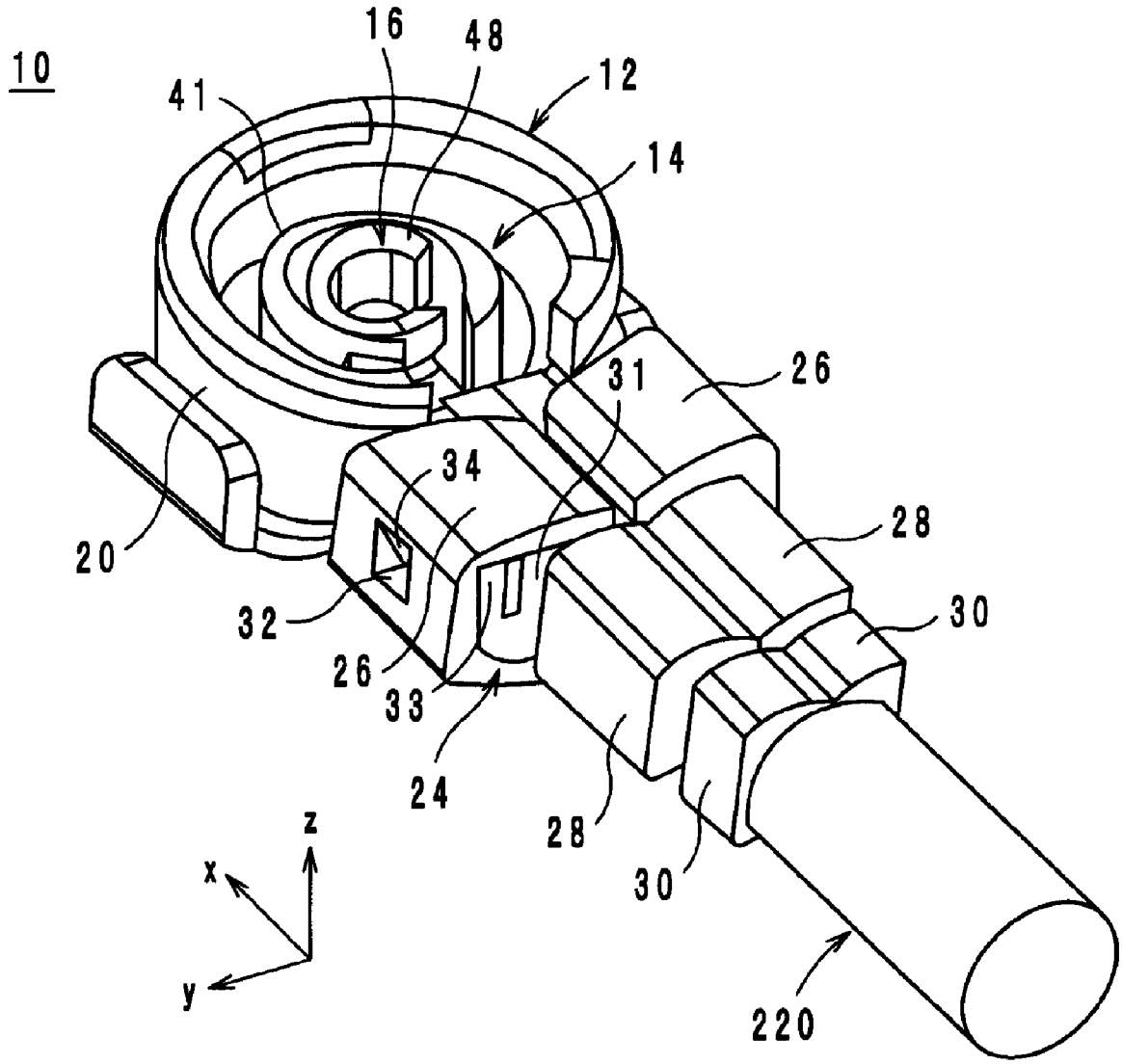
FIG. 1 is an external perspective view of an L-shaped coaxial connector according an embodiment to the present invention.
Figure 2:
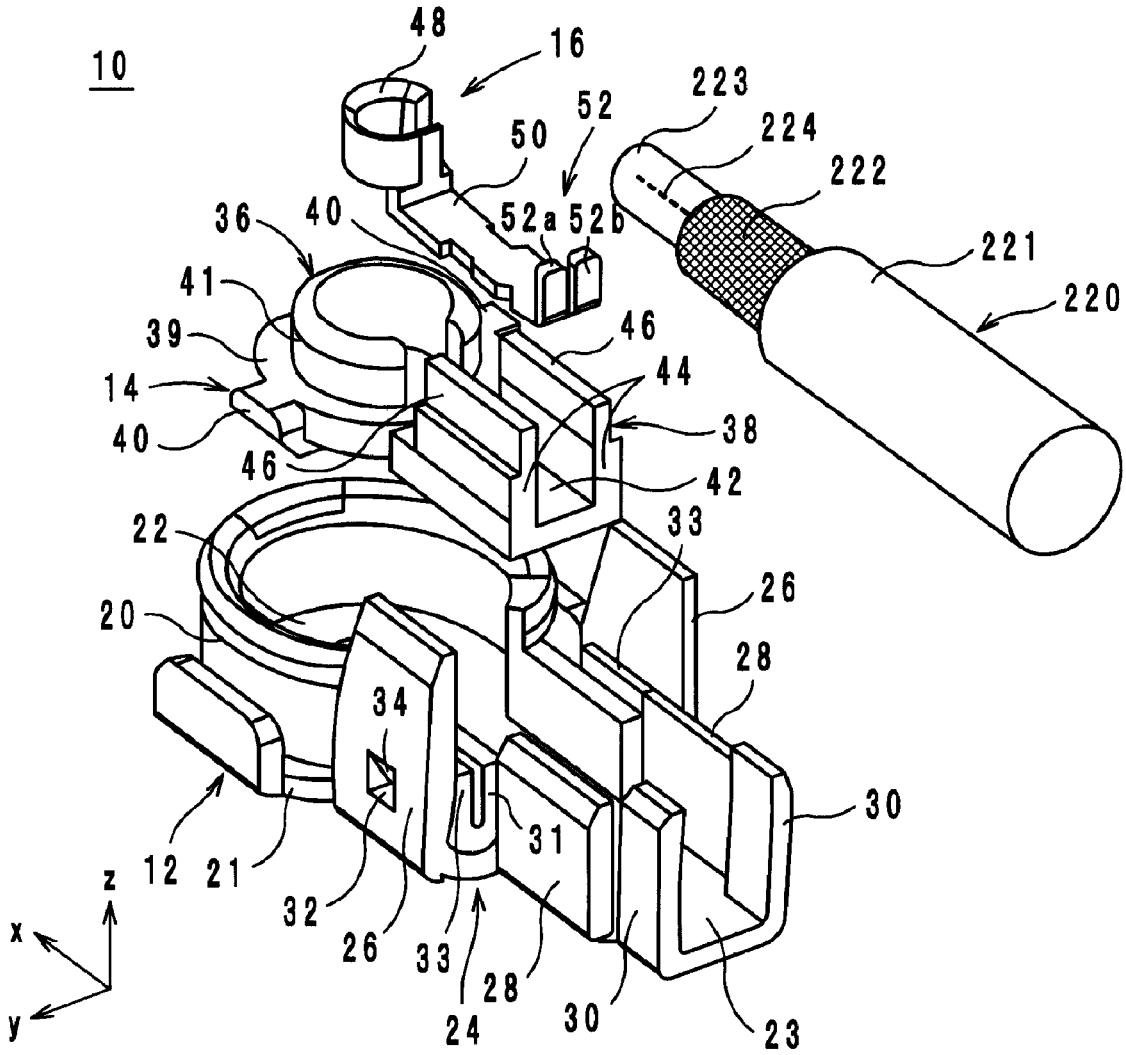
FIG. 2 is an exploded perspective view of the L-shaped coaxial connector shown in FIG. 1.
Figure 3A:
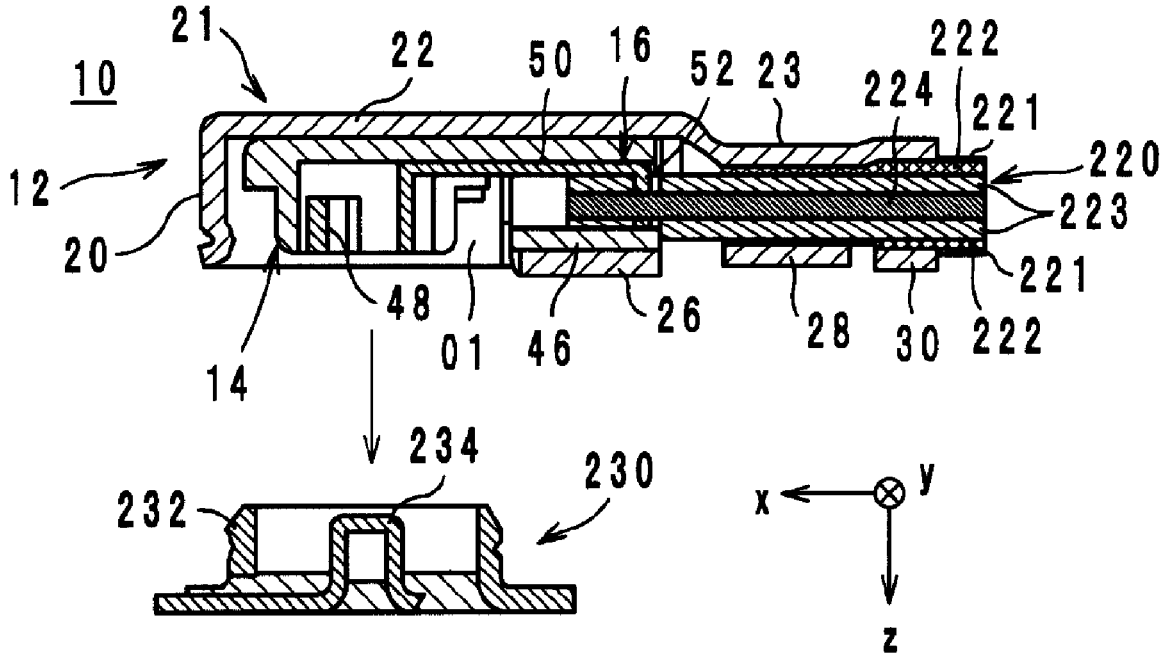
FIGS. 3A and 3B are cross-sectional structural views of the L-shaped coaxial connector shown in FIG. 1.
Figure 3B:
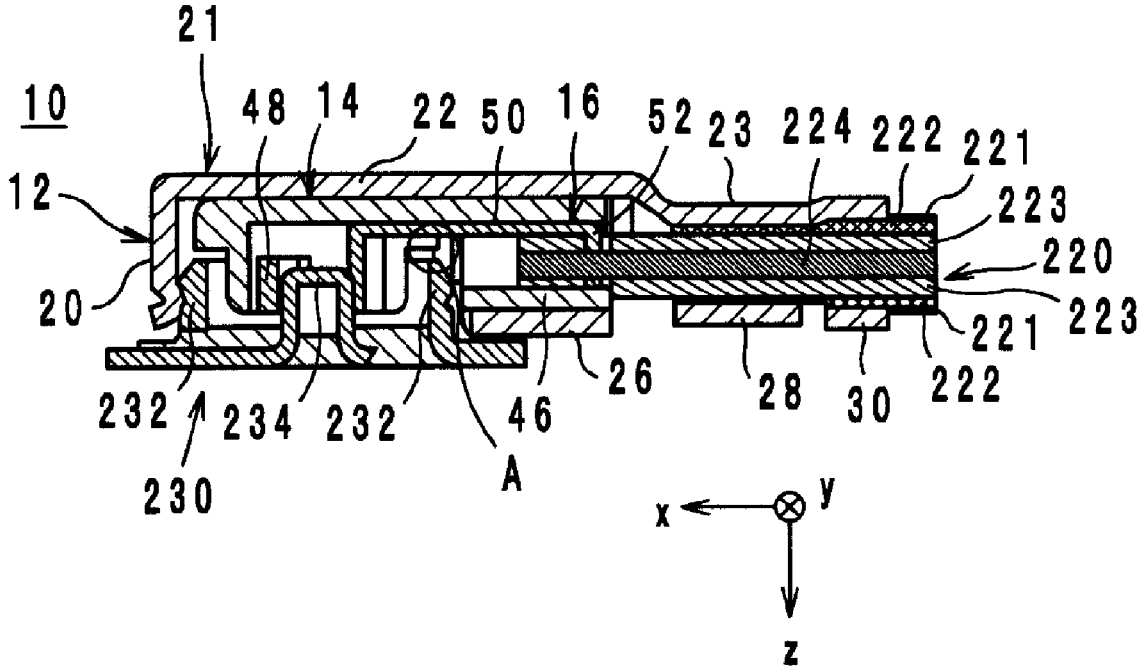
Figure 4:
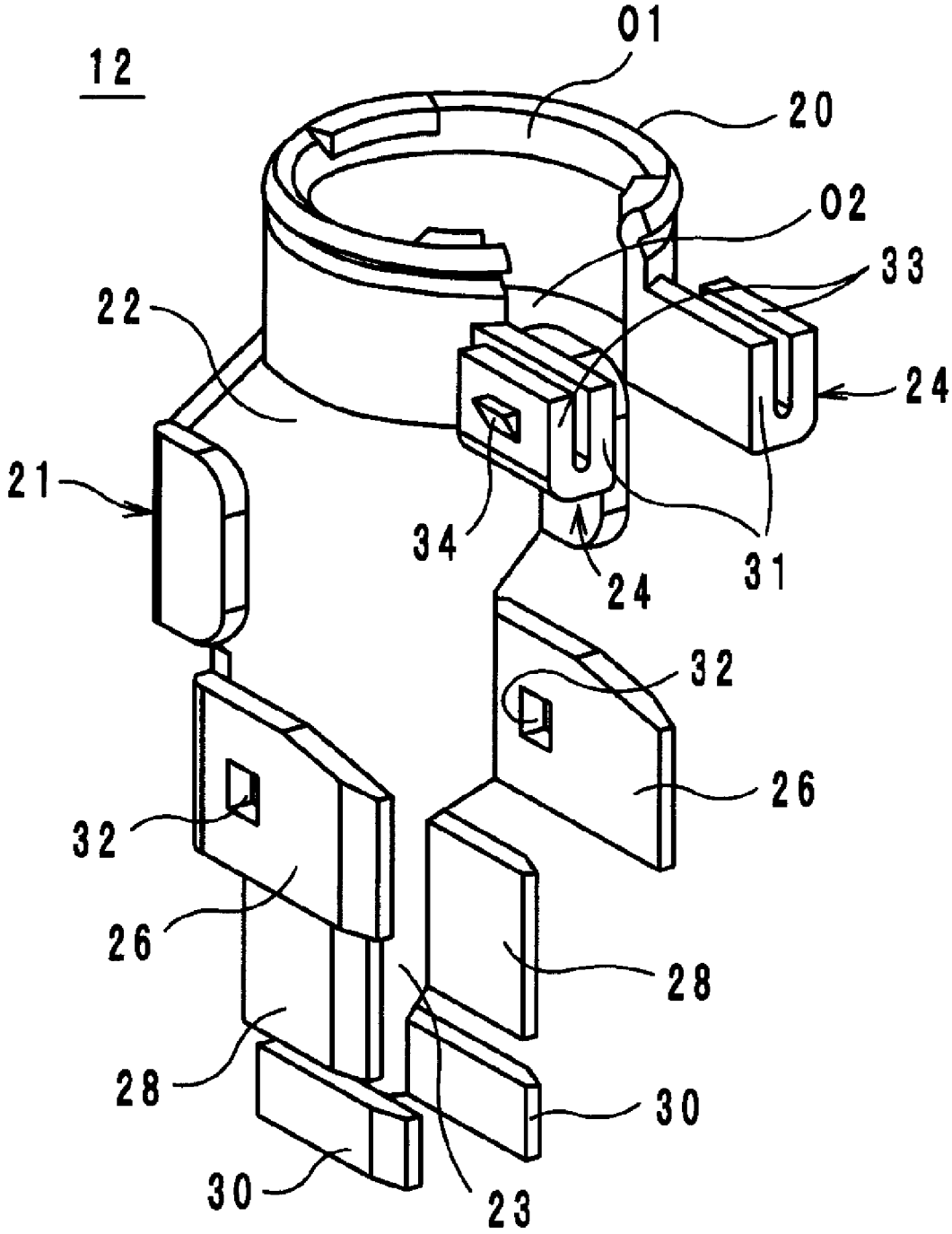
FIG. 4 is a perspective view of a housing of the L-shaped coaxial connector shown in FIG. 1 during assembling.
Figure 5:
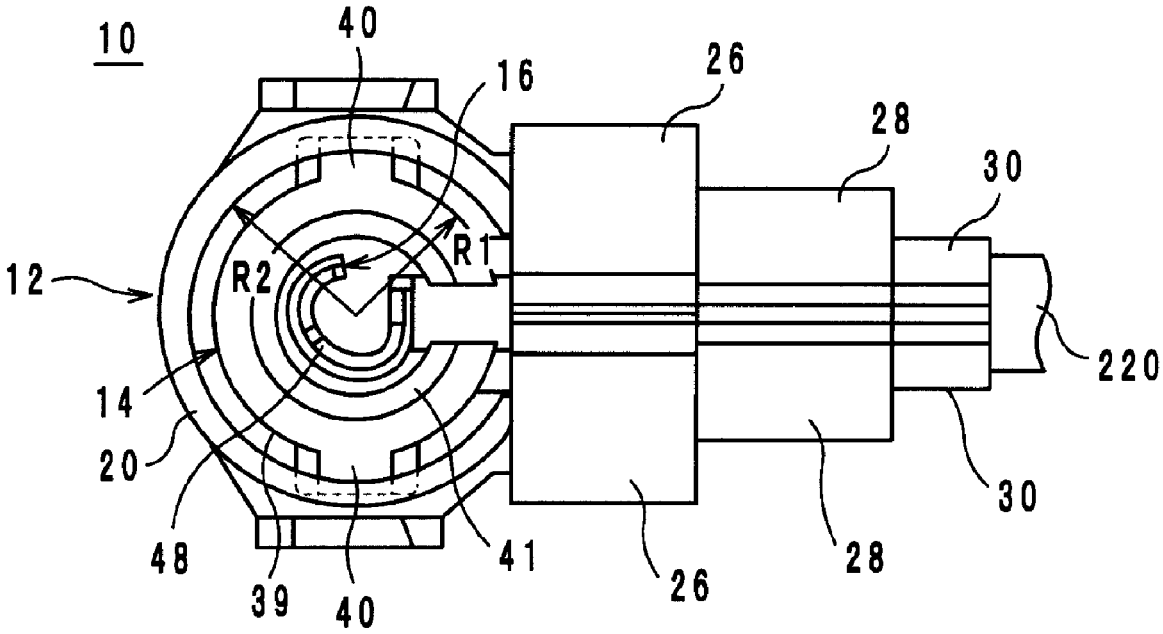
FIG. 5 is a plan view of the L-shaped coaxial connector shown in FIG. 1.

As summarized in the brief description of the drawings, FIG. 1 is an external perspective view of an L-shaped coaxial connector 10 according to an embodiment of the present invention. FIG. 2 is an exploded perspective view of the L-shaped coaxial connector 10. FIGS. 3A and 3B are cross-sectional structural views of the L-shaped coaxial connector 10. FIG. 4 is a perspective view of a housing 12 of the L-shaped coaxial connector 10 during assembling. FIG. 5 is a plan view of the L-shaped coaxial connector 10.

Hereinafter, the term "Z-direction" refers to a direction in which the housing 12, a bushing 14, and a socket 16 are superposed on one another as shown in FIGS. 1 to 3, in particular, FIG. 2. Hence, the direction from the housing 12 toward the socket 16 is the positive Z-direction.

The term "X-direction" refers to a direction in which a coaxial cable 220 extends. The term "Y-direction" refers to a direction perpendicular to an X-direction and a Z-direction. Hence, the direction from the coaxial cable 220 toward the socket 16 is the positive X-direction.

As shown in FIGS. 1 and 2, the L-shaped coaxial connector 10 includes the housing 12, the bushing 14, the socket 16, and the coaxial cable 220.

As shown in FIGS. 3A and 3B, the L-shaped coaxial connector 10 can be connected to and disconnected from a receptacle 230. The receptacle 230, to which the present L-shaped coaxial connector 10 may be connected, includes an external conductor 232 and a center conductor 234.

Figure 19:
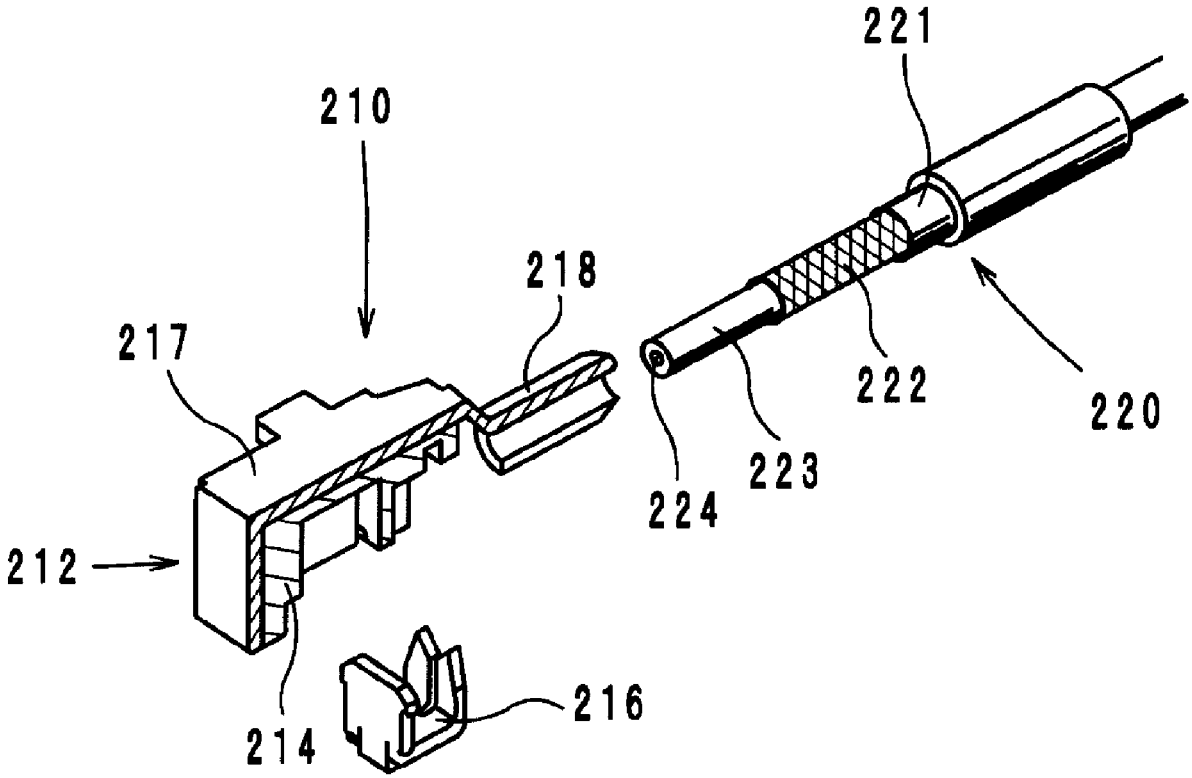
FIG. 19 is an exploded perspective view of an L-shaped coaxial plug connector of related art.

The coaxial cable 220, shown in prior art FIG. 19, includes an insulating film 221, an outer conductor 222, an insulating film 223, and a center conductor 224. The outer conductor 222 and the center conductor 224 are insulated from each other with the insulating film 223 therebetween. The insulating film 221 covers the outer conductor 222.

The housing 12 is made of a metal plate, for example, a phosphorus bronze plate used for springs. As shown in FIGS. 2 and 4, the housing 12 includes a cylinder portion 20, a back portion 21, fastening portions 24, and crimping portions 26, 28, and 30. A part of the cylinder portion 20 (i.e., a part on the negative X-direction side) is a cut out portion. The cylinder portion has an opening O1 on the positive Z-direction side and an opening O2 on the negative Z-direction side.

The back portion 21 is connected to the cylinder portion 20. The back portion 21 includes a lid portion 22 and an extension portion 23. The bushing 14 and the coaxial cable 220 are placed on the back portion 21. The lid portion 22 is a plate-shaped member connected to the cylinder portion 20. The lid portion 22 is bent by substantially 90 degrees from the state shown in FIG. 4 so as to cover the opening O2 of the cylinder portion 20, as shown in FIG. 2. The extension portion 23 is a plate-shaped member extending in the negative X-direction from the lid portion 22.

The fastening portions 24, each of which includes a supporting portion 31 and an elastic portion 33, are connected to the cylinder portion 20. As shown in FIG. 2, the fastening portions 24 and the bushing 14 are arranged in a Y-direction. As shown in FIG. 4, the supporting portions 31 are disposed at the ends of the cylinder portion 20 when the opening O1 is viewed from the positive Z-direction. Specifically, the two supporting portions 31 are plate-shaped members extending in the negative X-direction from the two ends of the cylinder portion 20 formed by being cut out. The supporting portions 31 face each other.

As shown in FIG. 4, the elastic portions 33 are plate-shaped members that are connected to the supporting portions 31 and face the supporting portions 31. Specifically, each of the supporting portions 31 and the corresponding elastic portion 33 are formed by bending a plate-shaped member into a substantially U-shape. A protruding portion 34 is formed on a side of each of the elastic portions 33 opposite the side facing the corresponding supporting portion 31.

As shown in FIG. 2, the crimping portions 26 are plate-shaped members extending in a direction perpendicular to the back portion 21 (i.e., Z-direction) before the L-shaped coaxial connector 10 is assembled. In this state, a part of the bushing 14 is exposed from the housing 12. The two crimping portions 26 face each other with the back portion 21 therebetween. The crimping portions 26 are pressed and in pressed contact with the bushing 14 when the crimping portions 26 are bent when the connector is assembled, as shown in FIG. 1. In this state, a part of the bushing 14 is exposed. Thus, the crimping portions 26 serve to fix the bushing 14, the socket 16, and the coaxial cable 220 to the housing 12.

As shown in FIG. 4, recessed portions 32 are formed in surfaces of the crimping portions 26, which face each other. The recessed portions 32 shown in FIG. 4 are holes extending through the crimping portions 26. The recessed portions 32 and the protruding portions 34 engage with each other when the back portion 21 is bent as shown in FIG. 2. Each pair of the recessed portions 32 and the protruding portions 34 constitute a holding mechanism that can maintain a state in which, by utilizing elasticity of the housing 12, the back portion 21 is in contact with the cylinder portion 20 and the lid portion 22 covers the opening O2, even when the crimping portions 26 are not bent. The recessed portions 32 may be formed in the elastic portions 33, and the protruding portions 34 may be formed on the crimping portions 26.

As shown in FIG. 4, the crimping portions 28 and 30 are plate-shaped members extending in a direction perpendicular to the back portion 21 (Z-direction) before the L-shaped coaxial connector 10 is assembled. The crimping portions 28 are disposed in pairs so as to face each other with the back portion 21 therebetween, and so are the crimping portions 30. That is, the crimping portions 28 and the back portion 21 form a substantially angular U-shape, and so do the crimping portions 30. However, the crimping portions 28 and the back portion 21 may form, for example, a substantially U-shape, and so may the crimping portions 30. The crimping portions 28 and 30 serve to fix the coaxial cable 220 to the housing 12 when the crimping portions are bent, as shown in FIG. 1. As described above, the crimping portions 26, 28, and 30 extend in the positive Z-direction before the L-shaped coaxial connector 10 is assembled. Thus, as shown in FIG. 2, the back portion 21, on which the bushing 14 is to be placed, is exposed when viewed from the positive Z-direction.

The bushing 14 is formed of an insulator made of plastic, for example, liquid crystal polymer, and serves to insulate the housing 12 and the socket 16 from each other. The bushing 14 is attached to the housing 12. As shown in FIG. 2, the bushing 14 includes a circular portion 36 and a holding portion 38.

The circular portion 36 serves to hold the socket 16. As shown in FIG. 2, the circular portion 36 includes a back portion 39, protruding portions 40, and a cylinder portion 41. The back portion 39 is a plate-shaped member that is circular in plan view from a Z-direction. As shown in FIG. 1, when the bushing 14 is attached to the housing 12, the back portion 39 is contained in the cylinder portion 20. That is, the protruding portions 40 are not included in the back portion 39. As shown in FIG. 5, the radius R1 of the back portion 39 is equal to or smaller than the radius R2 of the inner periphery of the cylinder portion 20. Thus, the back portion 39 can pass through the opening O1 in a Z-direction.

The protruding portions 40 extend from outer edges of the circular back portion 39 in directions extending outward from the center of the back portion 39 (i.e., in radial directions). The distance between the center of the back portion 39 and the tips of the protruding portions 40 is larger than the radius R2 of the inner periphery of the cylinder portion 20. Recessed portions (not shown) are formed in the inner periphery of the cylinder portion 20. As shown in FIG. 5, the protruding portions 40 are inserted into the recessed portions of the cylinder portion 20, when the bushing 14 is pressed into the housing 12 from the positive Z-direction as shown in FIG. 2. Thus, the bushing 14 is prevented from dropping off the housing 12.

As shown in FIG. 2, the cylinder portion 41 is disposed on a side of the back portion 39 facing the positive Z-direction. The cylinder portion 41 has a substantially annular shape with a cut out portion when viewed from a Z-direction. In FIG. 2, the cylinder portion 41 is cut out at the position at which the holding portion 38 is connected to the cylinder portion 41.

The holding portion 38 serves to hold the socket 16. As shown in FIG. 2, the holding portion 38 includes a back portion 42, two supporting portions 44, and two lid portions 46. The back portion 42 is a substantially rectangular plate-shaped member extending in the negative X-direction from the back portion 39 of the circular portion 36. As shown in FIG. 2, the socket 16 is placed on the back portion 42.

As shown in FIG. 2, the supporting portions 44 are plate-shaped members extending from the back portion 42 in a direction perpendicular to the back portion 42 (i.e., Z-direction). The supporting portions 44 face each other with the back portion 42 therebetween. The supporting portions 44 serve to support the socket 16 so that the socket 16 is not moved in a Y-direction. The lid portions 46 are plate-shaped members each extending in the positive Z-direction from the corresponding supporting portion 44 before the L-shaped coaxial connector 10 is assembled. The lid portions are bent together with the crimping portions 26 when assembled, such that the socket 16 and the coaxial cable 220 are attached to the bushing 14, and a part of the coaxial cable 220 is exposed. Thus, when the crimping portions 26 are pressed into and make contact with the lid portions 46, the lid portions 46 are in turn pressed into and make contact with the insulating film 223 by a force from the crimping portions 26. Accordingly, the lid portions 46 serve to fix the socket 16 and the coaxial cable 220 to the bushing 14.

The socket 16 is made of a metal plate, such as, for example, a phosphorus bronze plate used for springs. As shown in FIGS. 1 and 2, the socket is attached to the bushing 14 and is insulated from the housing 12 with the bushing 14. As shown in FIG. 2, the socket 16 includes a cylinder portion 48, a back portion 50, and an attaching portion 52. As shown in FIG. 2, the cylinder portion 48 is connected to a positive X-direction side of the back portion 50. The cylinder portion 48 has a substantially annular shape with a cut out portion when viewed from a Z-direction. The radius of the cylinder portion 48 is smaller than the radius of the cylinder portion 41 of the bushing 14. Thus, the cylinder portion 48 can be contained in the cylinder portion 41 as shown in FIG. 1 when the L-shaped coaxial connector 10 is assembled.

The back portion 50 is a plate-shaped member extending in the negative X-direction from the cylinder portion 41. The attaching portion 52 is formed by bending, perpendicularly in the positive Z-direction, an end of the back portion 50 on the negative X-direction side. The attaching portion 52 is connected to the center conductor 224 of the coaxial cable 220. Specifically, the attaching portion 52 includes a cutting pieces 52*a* and a cutting piece 52*b* disposed with a predetermined gap therebetween. The lid portions 46 press the coaxial cable 220 against the cutting pieces 52*a* and 52*b* in the negative Z-direction so that the center conductor 224 of the coaxial cable 220 is clamped in the predetermined gap between the cutting pieces 52*a* and 52*b*. Thus, the cutting pieces 52*a* and 52*b* are pressed into contact with the insulating film 223 of the coaxial cable 220 due to a force from the lid portions 46. Then, the cutting pieces 52*a* and 52*b* cut a part of or pierce into the insulating film 223 of the coaxial cable 220, so that the cutting pieces 52*a* and 52*b* contact the center conductor 224.

Figure 6:
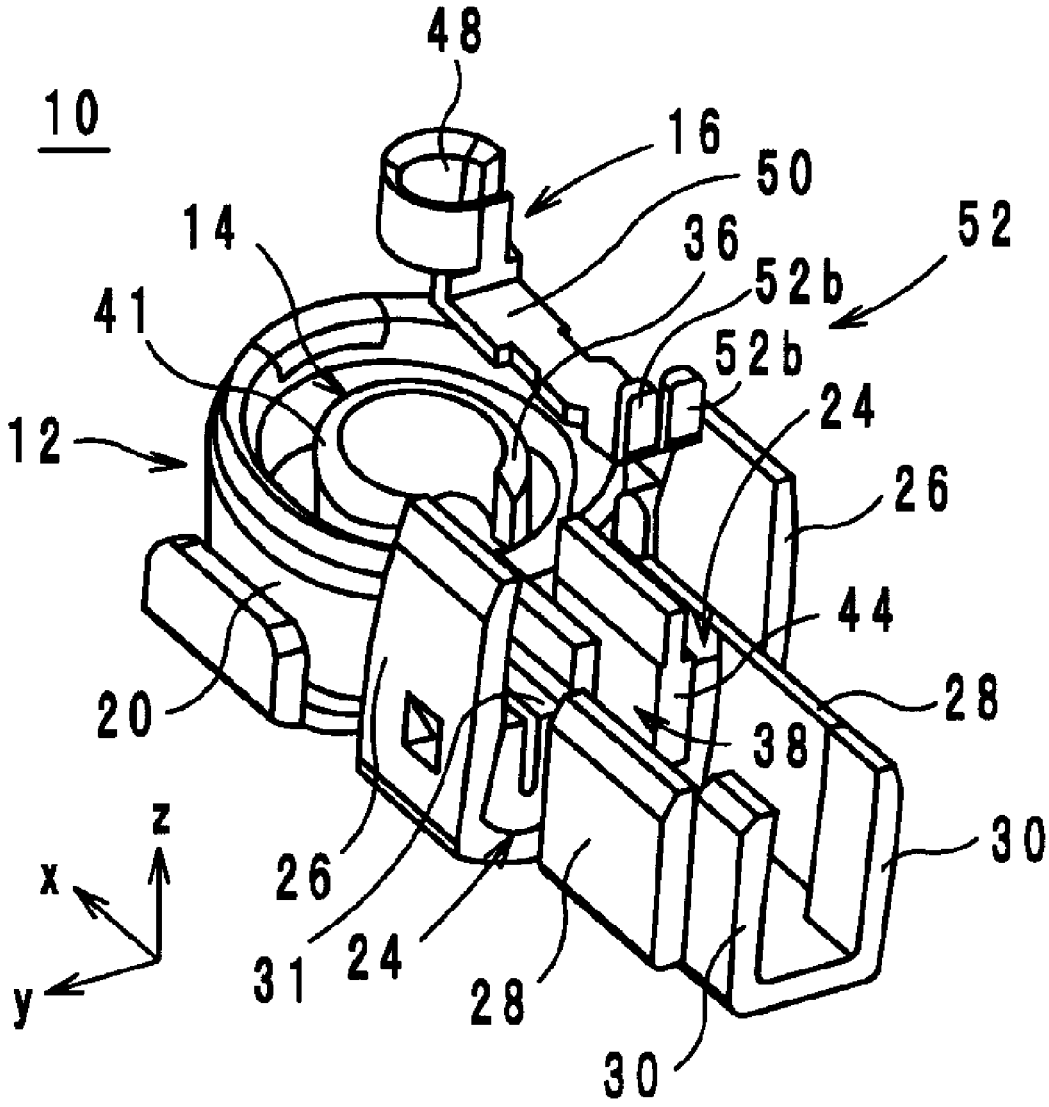
FIG. 6 is an exploded perspective view of the L-shaped coaxial connector shown in FIG. 1 during assembling.
Figure 7:
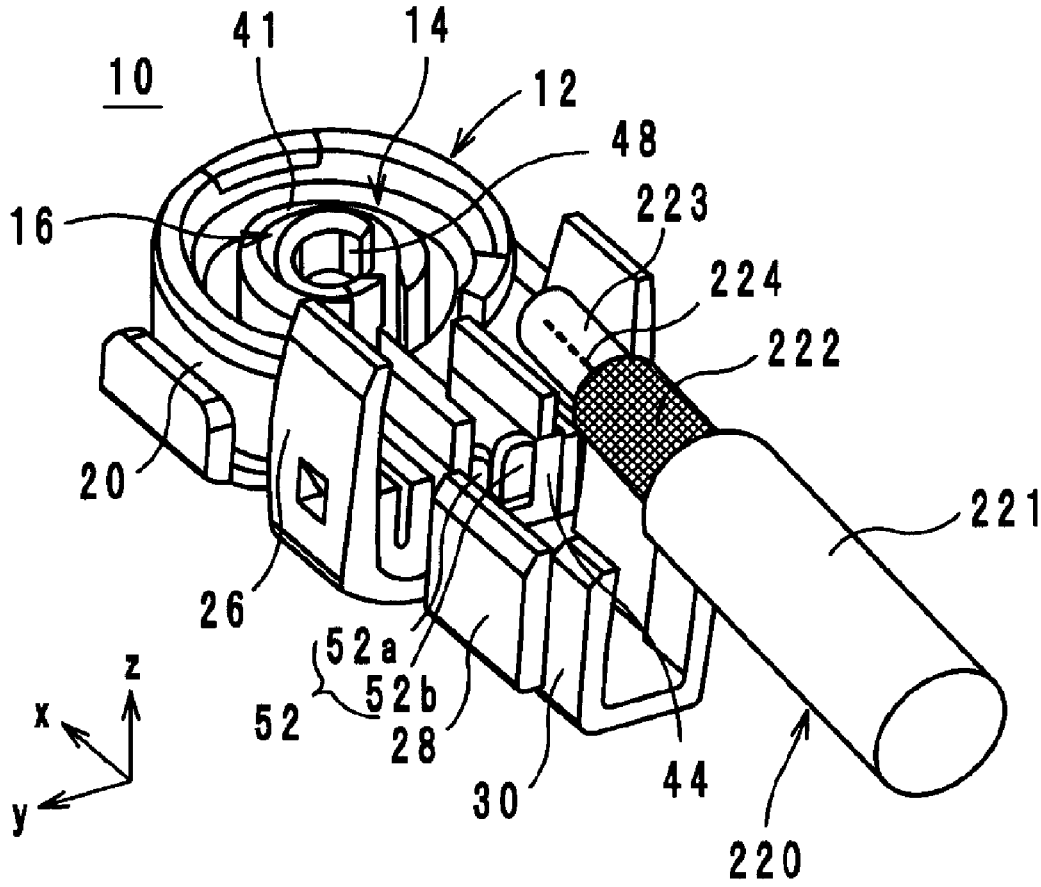
FIG. 7 is an exploded perspective view of the L-shaped coaxial connector shown in FIG. 1 during assembling.
Figure 8:
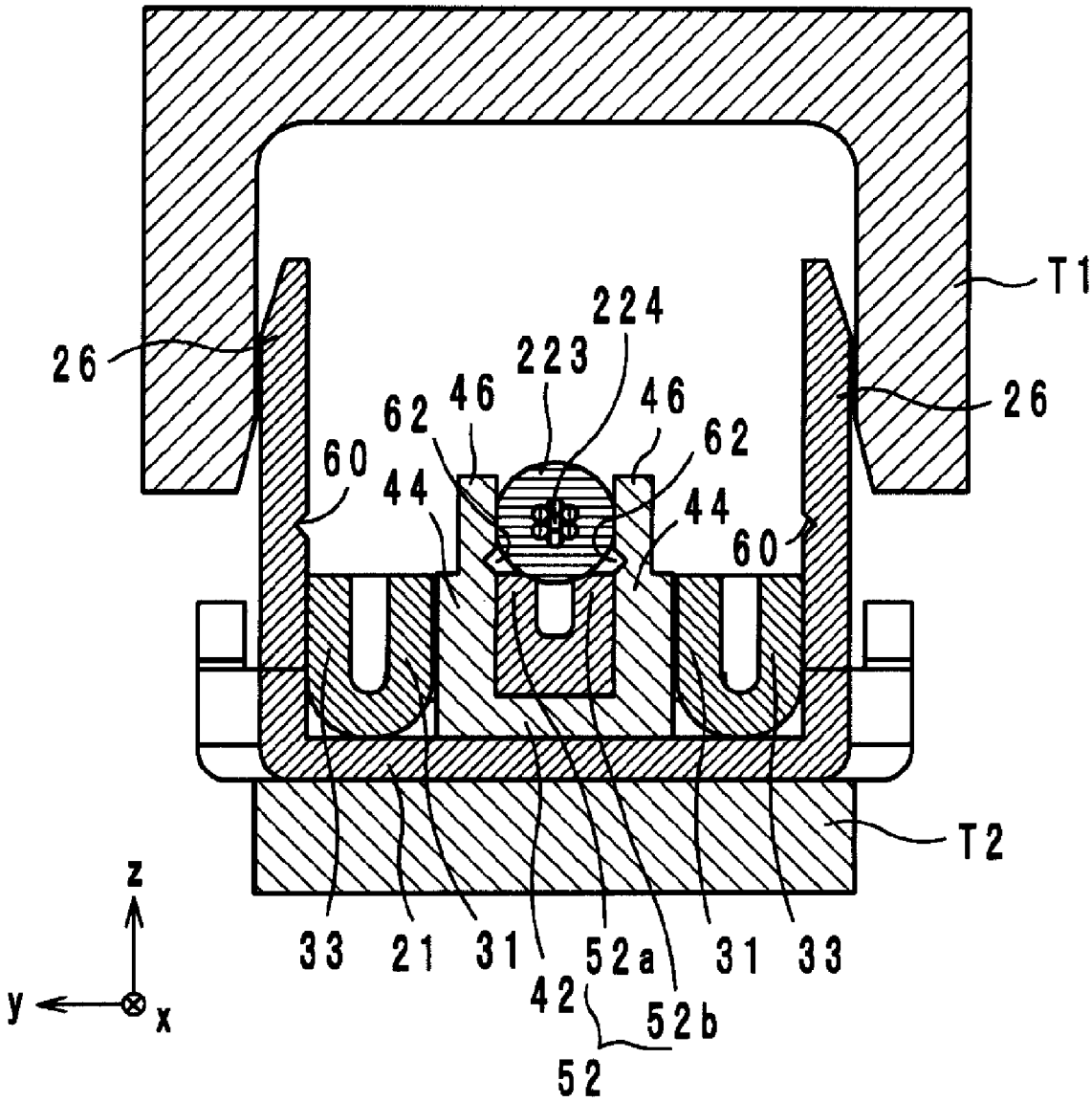
FIG. 8 is a sectional view of the-shaped coaxial connector shown in FIG. 1 during assembling.
Figure 9:
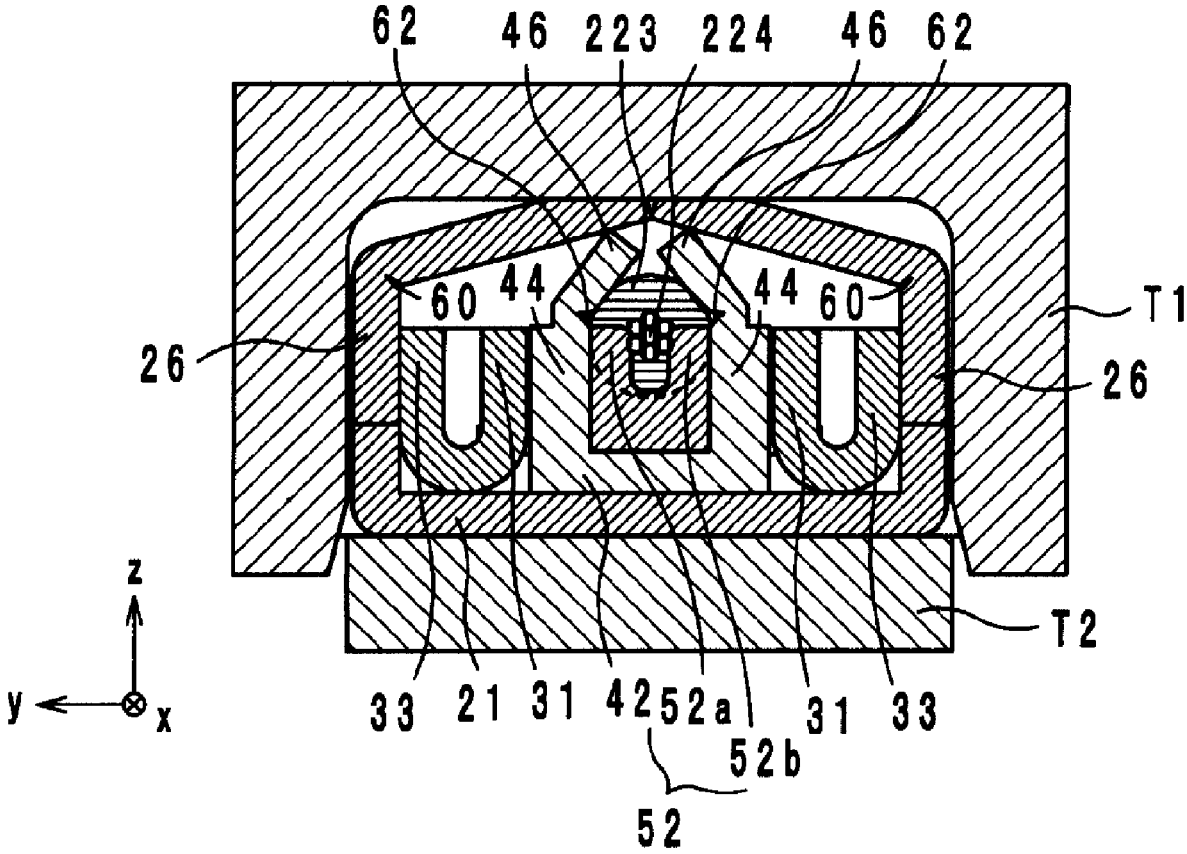
FIG. 9 is a sectional view of the L-shaped coaxial connector shown in FIG. 1 during assembling.
Figure 10:
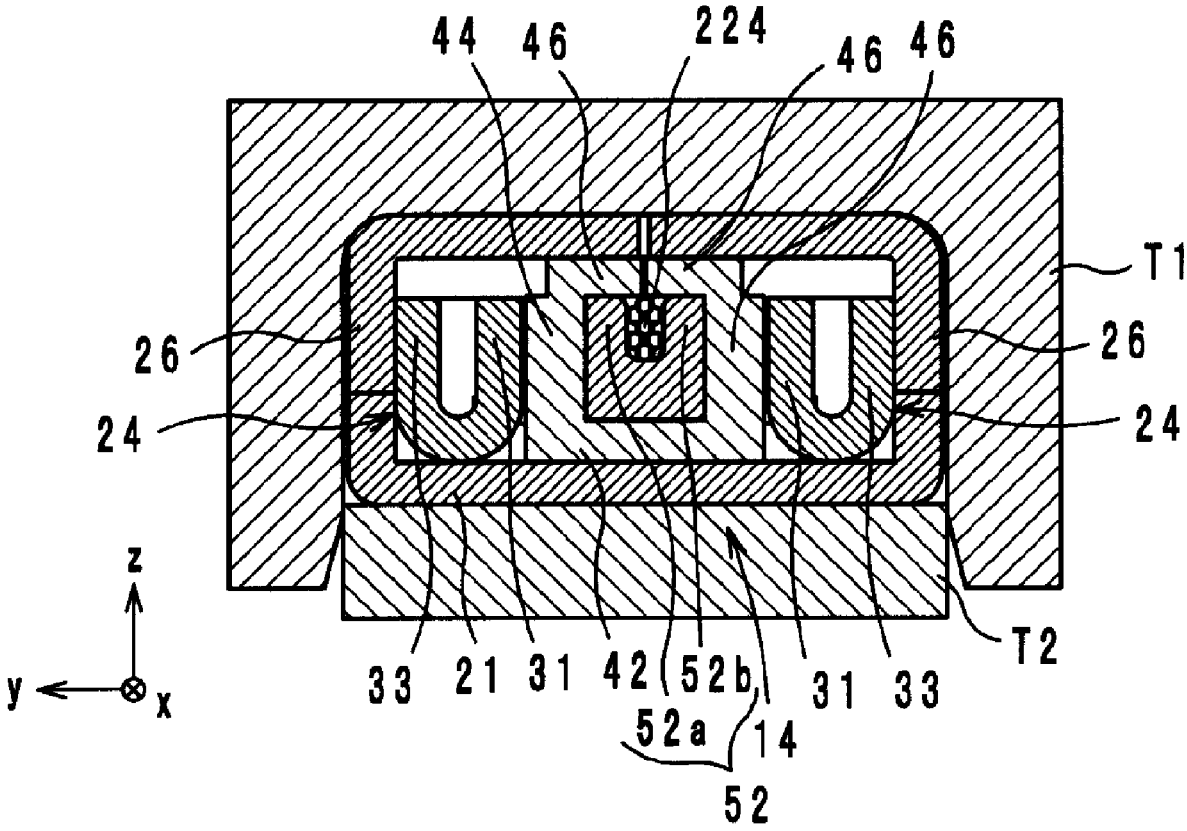
FIG. 10 is a sectional view of the L-shaped coaxial connector shown in FIG. 1 during assembling.

The L-shaped coaxial connector 10, which has the above-described structure, is assembled using the procedure described below. FIGS. 6 and 7 are exploded perspective views of the L-shaped coaxial connector 10 during assembling. FIGS. 8 to 10 are sectional views of the L-shaped coaxial connector 10 during assembling.

First, as shown in FIG. 6, the bushing 14 is attached to the housing 12. Specifically, the bushing 14 is pressed into the housing 12 from the positive Z-direction so that the cylinder portion 20 is contained in the circular portion 36 and the holding portion 38 is disposed between the supporting portions 31. As shown in FIG. 5, at this time, the protruding portions 40 are inserted into the recessed portions of the cylinder portion 20.

Next, as shown in FIGS. 6 and 7, the socket 16 is attached to the bushing 14. Specifically, the socket 16 is attached to the bushing 14 from the positive Z-direction so that the cylinder portion 41 is contained in the cylinder portion 48 and the back portion 50 and attaching portion 52 are disposed between the supporting portions 44. In FIGS. 6 and 7, only one of the supporting portions 44 is shown. In this state, since the crimping portions 26 have not been bent, the bushing 14 is exposed in the positive Z-direction.

Next, as shown in FIG. 7, the coaxial cable 220 is placed on the attaching portion 52. At this time, an end of the coaxial cable 220 has been stripped so that the outer conductor 222 and the insulating film 223 are exposed. However, the center conductor 224 is not exposed. The coaxial cable 220 is placed on the socket 16 so that the insulating film 223 is disposed on the attaching portion 52, the outer conductor 222 is disposed between the crimping portions 28, and the insulating film 221 is disposed between the crimping portions 30.

After the coaxial cable 220 has been placed on the socket 16, a process of crimping the crimping portions 26, 28, and 30 is performed. In the crimping process, the crimping portions 26 are bent, in a state in which a part of the bushing 14 is exposed, so that the center conductor 224 is connected to the attaching portion 52. As shown in FIGS. 8 and 10, the crimping process is performed by using jigs T1 and T2. First, the L-shaped coaxial connector 10 is placed on the jig T2. Next, as shown in FIG. 8, the jig T1 is lowered from the positive Z-direction. As shown in FIG. 8, the jig T1 has a substantially angular U-shaped cross-section that is open in the negative Z-direction. The jig T1 is lowered so that the L-shaped coaxial connector 10 is contained in or enclosed by the jig T1.

As the jig T1 is lowered, the crimping portions 26 contact the jig T1. As shown in FIG. 8, grooves 60 are formed in the crimping portions 26. Therefore, when the jig T1 applies a force from the positive Z-direction, the crimping portions 26 are bent at the grooves 60.

As shown in FIG. 9, when the jig T1 is lowered further, the crimping portions 26 contact the lid portions 46. As shown in FIG. 8, grooves 62 are formed between the supporting portions 44 and the lid portions 46. Therefore, when the crimping portions 26 apply a force to the lid portions 46 from the positive Z-direction, the lid portions 46 are bent at the grooves 62 as shown in FIG. 9.

When the lid portions 46 are bent, the lid portions 46 press the insulating film 223 of the coaxial cable 220 against the attaching portion 52. At this time, a part of the insulating film 223 is cut by the attaching portion 52. Thus, as shown in FIG. 9, the center conductor 224 of the coaxial cable 220 enters the gap in the attaching portion 52.

As shown in FIG. 10, when the jig T1 is lowered further, the crimping portions 26 are closed, and the lid portions 46 are closed. At this time, the crimping portions are bent so that the crimping portions face the back portion 21 with the bushing 14 and the fastening portions 24 therebetween, whereby the bushing 14 is fixed to the housing 12. The fastening portions 24 are disposed between the bushing 14 and the crimping portions 26 in a Y-direction. The elastic portions 33 are in pressed contact with the crimping portions 26.

The center conductor 224 of the coaxial cable 220 is disposed in the gap between the cutting pieces 52*a* and 52*b* of the attaching portion 52. Thus, the center conductor 224 is connected to the attaching portion 52, and the center conductor 224 is electrically connected to the socket 16.

In the process of crimping the crimping portions 26, the crimping portions 28 and 30 can be simultaneously crimped. The crimping portions 28 are crimped so as to surround the outer conductor 222. Thus, the outer conductor 222 is electrically connected to the housing 12 at the crimping portions 28. Moreover, the crimping portions 30 are crimped so as to surround the insulating film 221. Through the above-described process, the L-shaped coaxial connector 10 is provided with the structure shown in FIG. 1.

Next, how the L-shaped coaxial connector 10 can be connected to and disconnected from the receptacle 230 is described.

As shown in FIG. 3A, the receptacle 230 includes the external conductor 232 and the center conductor 234. The external conductor 232 is an electrode having a substantially cylindrical shape. The center conductor 234 is an electrode extending along the axis of the external conductor 232.

As shown in FIGS. 3A and 3B, to connect the L-shaped coaxial connector 10 to the receptacle 230, the external conductor 232 is inserted through the opening O1 into the cylinder portion 20. Thus, the inner periphery of the cylinder portion 20 contacts the outer periphery of the external conductor 232, so that the outer conductor 222 of the coaxial cable 220 is electrically connected the external conductor 232 of the receptacle 230 through the housing 12. At this time, the cylinder portion 20 is expanded by the external conductor 232. Thus, the inner periphery of the cylinder portion 20 is pressed into contact with the outer periphery of the external conductor 232, whereby the L-shaped coaxial connector 10 is prevented from easily disconnected from the receptacle 230.

As shown in FIGS. 3A and 3B, at the same time when the external conductor 232 is inserted into the cylinder portion 20, the center conductor 234 is inserted into the cylinder portion 48 of the socket 16. Thus, the outer periphery of the center conductor 234 contacts the inner periphery of the cylinder portion 48 so that the center conductor 224 of the coaxial cable 220 is electrically connected to the center conductor 234 of the receptacle 230 through the socket 16.

The L-shaped coaxial connector 10 having the above-described structure can be manufactured with a relatively small number of processes as described below compared to the manufacturing of the L-shaped coaxial plug connector 210 shown in prior art FIG. 19.

In the manufacturing of the prior art L-shaped coaxial plug connector 210 shown in FIG. 19, the cable gripper 218 is crimped so as to fix the coaxial cable 220 to the case 212, and the contact 216 is then pressed into the insulator 214. At this time, the contact 216 breaks through the insulating film 223 of the coaxial cable 220 so as to make contact with the center conductor 224. Thus, with the L-shaped coaxial plug connector 210, a process of crimping the cable gripper 218 and a process of connecting the contact 216 to the center conductor 224 have to be separately performed.

On the other hand, with the L-shaped coaxial connector 10 of the present invention, when the crimping portions 26 are bent, the crimping portions 26 are pressed onto and make contact with the lid portions 46 of the bushing 14, and, accordingly, the lid portions 46 are pressed into and make contact with the insulating film 223 of the coaxial cable 220. The attaching portion 52 of the socket 16 is then pressed into and make contact with the insulating film 223. Specifically, the cutting pieces 52*a* and 52*b* of the attaching portion 52 breaks the insulating film 223 with a force from the lid portions 46 so as to be connected to the center conductor 224. That is, the process of crimping the crimping portions 26 includes the process of connecting the center conductor 224 to the socket 16. Thus, it is not necessary that these processes be performed separately. As a result, the L-shaped coaxial connector 10 can be manufactured with a smaller number of processes compared to the manufacturing of the connector shown in prior art FIG. 19.

The L-shaped coaxial connector 10 can be manufactured at low costs as described below. Specifically, as shown in FIG. 5, with the L-shaped coaxial connector 10, the radius R1 of the back portion 39 is equal to or smaller than the radius R2 of the cylinder portion 20. Therefore, the back portion 39 can pass through the opening O1 of the cylinder portion 20 from the positive Z-direction. That is, the back portion 39 can be attached from the positive Z-direction.

Moreover, the crimping portions 26 are bent so that the crimping portions 26 face the back portion 21 with the bushing 14 therebetween so as to fix the bushing 14 to the housing 12. Therefore, before the crimping portions 26 are bent, the holding portion 38 of the bushing 14 is exposed in the positive Z-direction as shown in FIG. 2, and the holding portion 38 of the bushing 14 can be attached to the housing 12 from the positive Z-direction. Accordingly, with the L-shaped coaxial connector 10, the bushing 14 can be attached to the housing 12 from the positive Z-direction.

Since the bushing 14 can be attached to the housing 12 from the positive Z-direction, even when the opening O2 of the cylinder portion 20 is covered by the back portion 21 as shown in FIG. 2, the bushing 14 can be attached to the housing 12. Therefore, with the L-shaped coaxial connector 10, the process of manufacturing the housing 12 as shown in FIG. 4 and the process of bending the back portion 21 can be continuously performed on one manufacturing line. As a result, the L-shaped coaxial connector 10 can be manufactured at low costs.

Moreover, the L-shaped coaxial connector 10 has the recessed portions 32 and the protruding portions 34 as shown in FIG. 4. The recessed portions 32 engage with the protruding portions 34, and the crimping portions 26 are fixed to the fastening portions 24. As a result, as shown in FIG. 2, even in a state in which the crimping portions 26 have not been crimped, the housing 12 can maintain a sate in which the back portion 21 is bent and the back portion 21 covers the opening O2.

Figure 11:
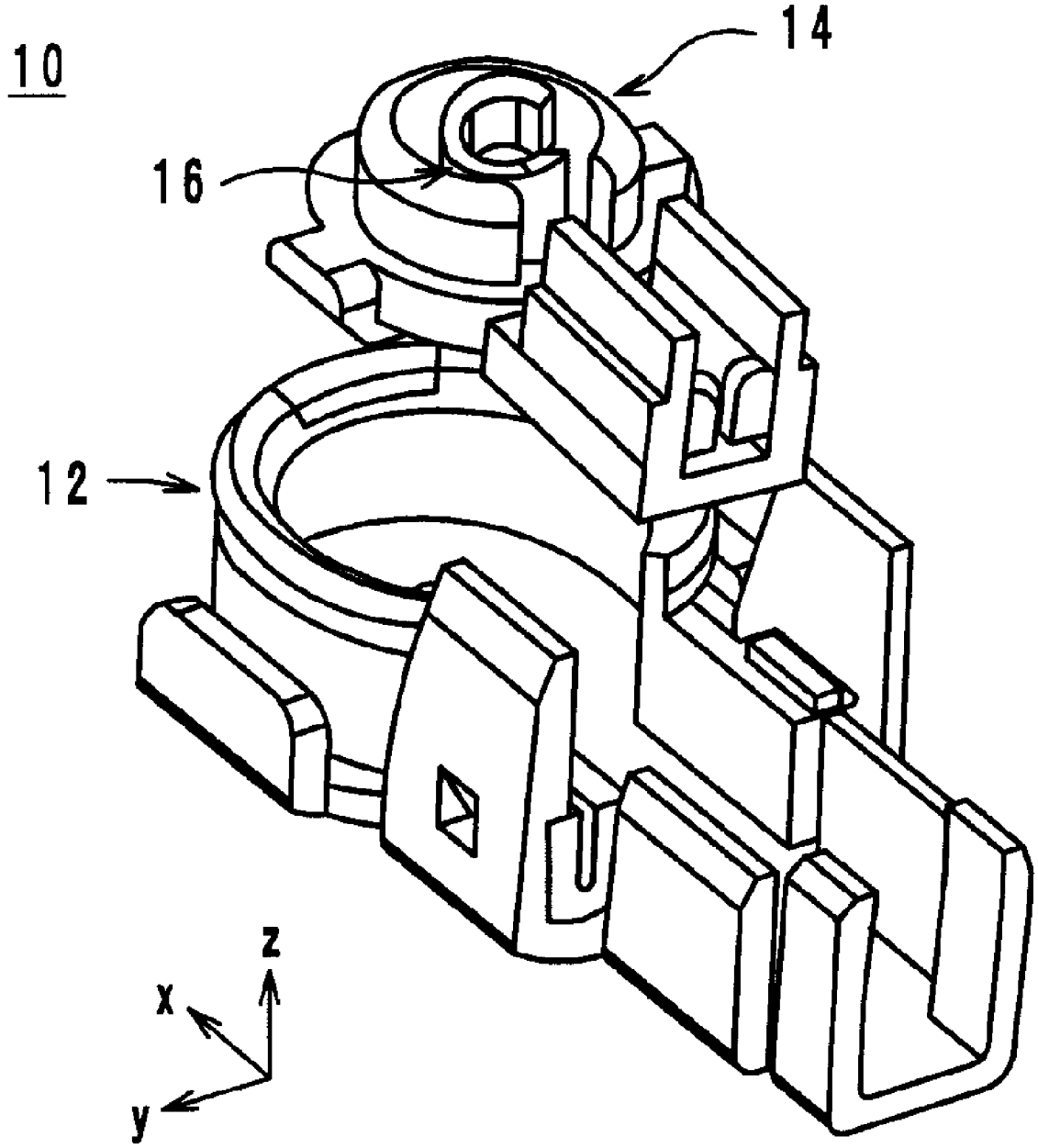
FIG. 11 is an exploded perspective view of the L-shaped coaxial connector during assembling by another assembling method.
Figure 12:
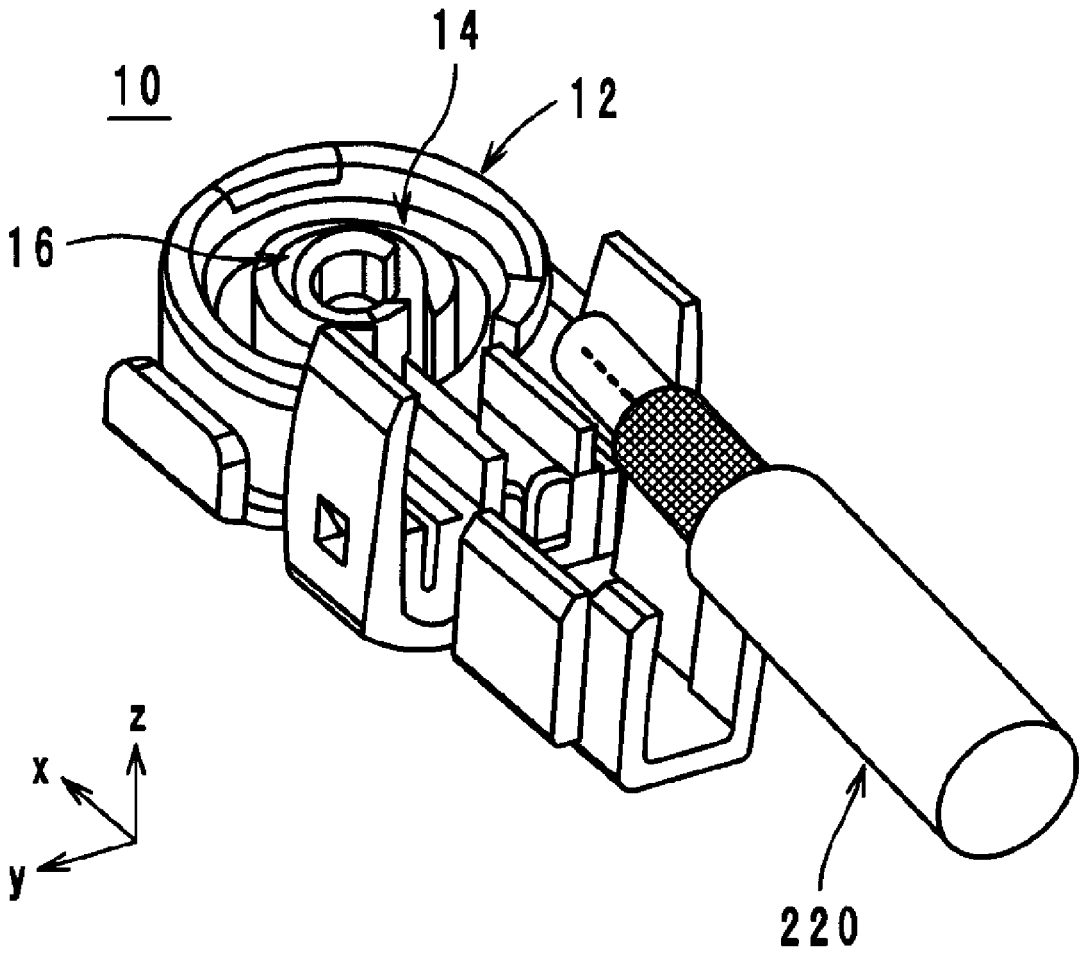
FIG. 12 is an exploded perspective view of the L-shaped coaxial connector during assembling by another assembling method.

The L-shaped coaxial connector 10 is not limited to the above-described embodiment. The L-shaped coaxial connector 10 can be modified within the spirit of thereof. Hereinafter, modifications of the L-shaped coaxial connector 10 are described with reference to the drawings. FIGS. 11 and 12 are exploded perspective views of the L-shaped coaxial connector 10 during assembling by other assembling methods.

In the above-described embodiment, the bushing 14 is attached to the housing 12, and then the socket 16 is attached to the bushing 14, as shown in FIGS. 6 and 7. However, the bushing 14 and the socket 16 may be assembled in a different order. For example, the socket 16 may be first attached to the bushing 14 as shown in FIG. 11, and then the bushing 14 may be attached to the housing 12 as shown in FIG. 12.

As shown in FIG. 2, the cylinder portion 41 of the bushing 14 has a cutout. This cutout allows the socket 16 to be attached to the bushing 14 from the positive Z-direction. However, with the bushing 14, the socket 16 and the external conductor 232 may short-circuit at a position A shown in FIG. 3B. Specifically, since the cylinder portion 41 has a cutout, the back portion 50 of the socket 16 is exposed in the positive Z-direction at the cutout. When the receptacle 230 is attached to the L-shaped coaxial connector 10 having the socket 16, the back portion 50 is disposed close to the external conductor 232 at a position at which the back portion 50 is exposed. As a result, when, for example, the L-shaped coaxial connector 10 is forcefully pressed against the receptacle 230, the socket 16 and the external conductor 232 may short-circuit. Therefore, modification is possible to avoid such a possibility of a short-circuit.

Figure 13:
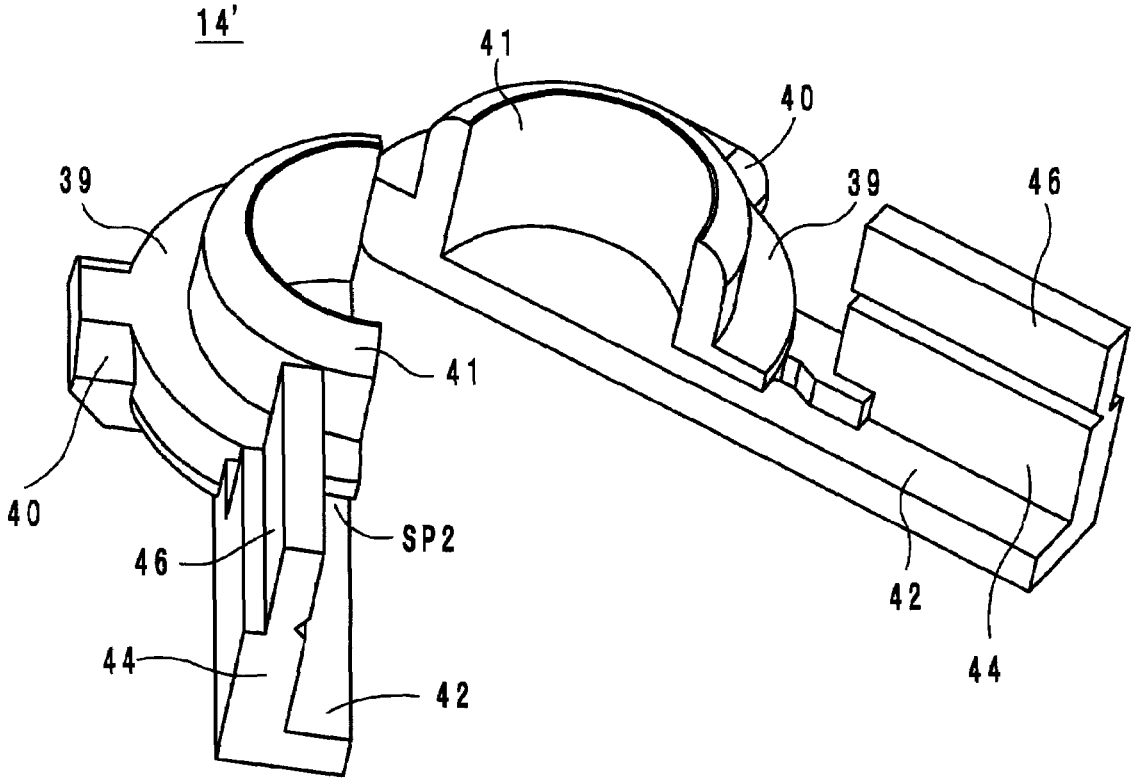
FIG. 13 is an external perspective view of a bushing according to a modification.

To avoid possible short-circuiting, a bushing 14', which is shown in an external perspective view of FIG. 13, may be used. The bushing 14' shown in FIG. 13 does not have a cutout in the cylinder portion 41. Instead, the bushing 14' is divided into two portions by an XZ-plane. Moreover, gaps SP2 are formed between the bottom surface of the cylinder portion 41 and the upper surface of the back portion 42. The socket 16 is placed on the back portion 42 such that the socket extends through the gaps SP2. Then, two divided portions of the bushing 14' are mated. Thereafter, the bushing 14' and the coaxial cable 220 are attached to the housing 12 by a process similar to that shown in FIGS. 11 and 12. Lastly, the crimping portions 26, 28, and 30 are crimped so as to complete assembling of the L-shaped coaxial connector 10.

Since the cylinder portion 41 of the bushing 14' shown in FIG. 13 does not have a cutout, the back portion 50 of the socket 16 is not exposed in the positive Z-direction. Thus, even when, for example, the L-shaped coaxial connector is forcefully pressed against the receptacle 230, the socket 16 and the external conductor 232 do not short-circuit. In using the bushing 14', it is necessary to attach the bushing 14' to the housing 12 after the socket 16 has been attached to the bushing 14'.

Figure 14:
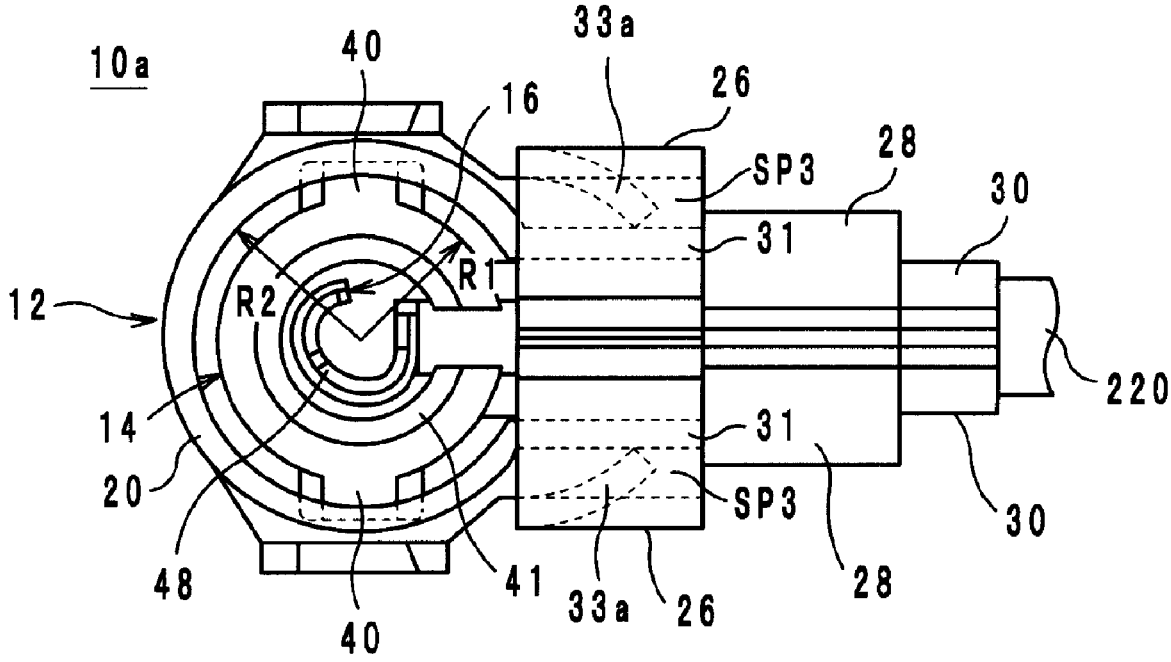
FIG. 14 is a plan view of an L-shaped coaxial connector according to a first modification.
Figure 15:
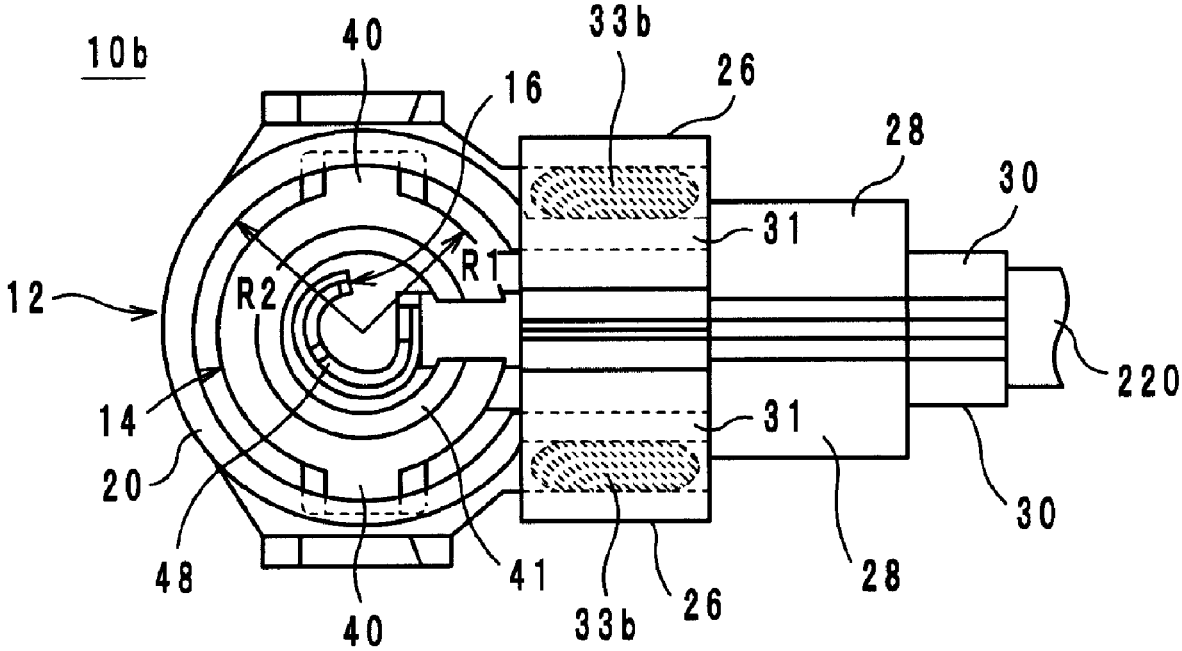
FIG. 15 is a plan view of an L-shaped coaxial connector according to a second modification.

As shown in FIG. 2, with the L-shaped coaxial connector 10 according to the above-described embodiment, the elastic portions 33 is made by bending the supporting portions 31 into a substantial U-shape. However, the structure of the elastic portions 33 is not limited thereto. FIG. 14 is a plan view of an L-shaped coaxial connector 10*a* according to a first modification. FIG. 15 is a plan view of an L-shaped coaxial connector 10*b* according to a second modification.

In the L-shaped coaxial connector 10*a*, the crimping portions 26 and the supporting portions 31 are plate-shaped members disposed with gaps SP3 therebetween. The crimping portions 26 include elastic portions 33*a*. To be specific, the elastic portions 33*a* are made by bending parts of the crimping portions 26, and the elastic portions are in pressed contact with the supporting portions 31.

With the L-shaped coaxial connector 10*a*, as with the L-shaped coaxial connector 10, an elastic force can be applied between the crimping portions 26 and the supporting portions 31, so that the cylinder portion 20 can be easily pressed into contact with the external conductor 232 with an appropriate force. As a result, the L-shaped coaxial connector 10*a* can be connected to and disconnected from a receptacle with an appropriate force.

With the L-shaped coaxial connector 10*a* shown in FIG. 14, the elastic portions 33*a* are made by bending parts of the crimping portions 26, and the elastic portions 33*a* are pressed into contact with the supporting portions 31. However, for example, the elastic portions 33*a* may be made by bending parts of the supporting portions 31, and the elastic portions 33*a* may be pressed into contact with the crimping portions 26.

The elastic portions 33 may be formed as members independent of the housing 12, such as elastic portions 33*b* as shown in FIG. 15. The elastic portions 33*b* are elastic members made of elastomer, and disposed between the crimping portions 26 and the supporting portions 31.

With an L-shaped coaxial connector 10*b*, as with the L-shaped coaxial connector 10, an elastic force can be applied between the crimping portions 26 and the supporting portions 31, so that the cylinder portion 20 can be easily pressed into contact with the external conductor 232 with an appropriate force. As a result, the L-shaped coaxial connector 10*b* can be connected to and disconnected from a receptacle with an appropriate force.

Figure 16:
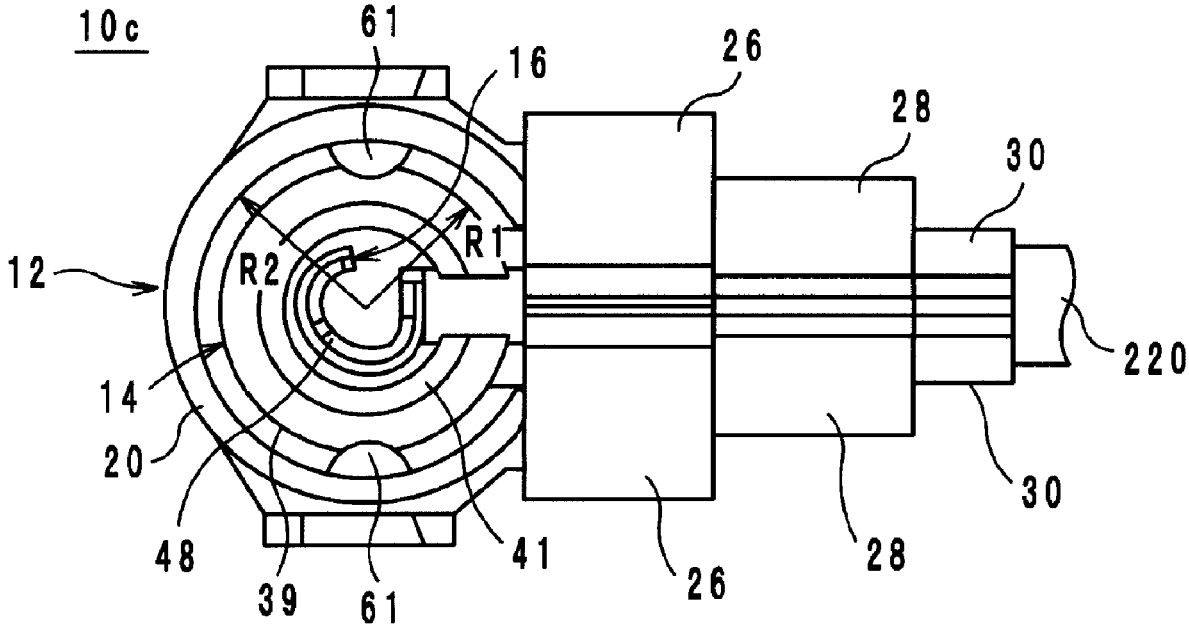
FIG. 16 is a plan view of an L-shaped coaxial connector according to a third modification.

As shown in FIG. 5, with the L-shaped coaxial connector 10 of the above-described embodiment, the protruding portions 40 protruding from the back portion 39 and the recessed portions in the inner periphery of the cylinder portion 20 engage with each other, so that the bushing 14 is prevented from dropping off the housing 12. However, a structure for preventing the bushing 14 from dropping off the housing 12 is not limited thereto. FIG. 16 is a plan view of an L-shaped coaxial connector 10*c* according to a third modification.

As shown in FIG. 16, the housing 12 may further include protruding portions 61 protruding inward in the opening O1 of the cylinder portion 20. With this structure, the protruding portions 61 slightly overlap the bushing 14 in plan view in a Z-direction, so that the bushing 14 can be prevented from dropping off the housing 12.

Figure 17A:
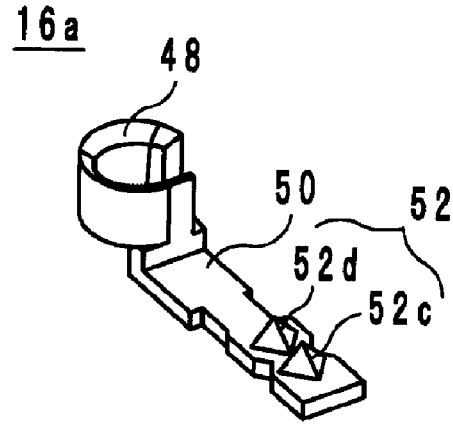
FIGS. 17A, 17B, and 17C are external perspective views of sockets according to first, second, and third modifications, respectively.
Figure 17B:
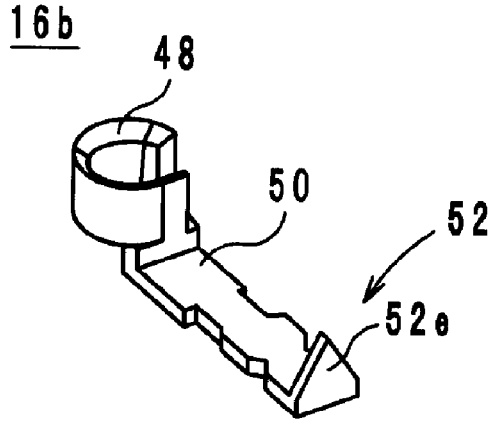
Figure 17C:
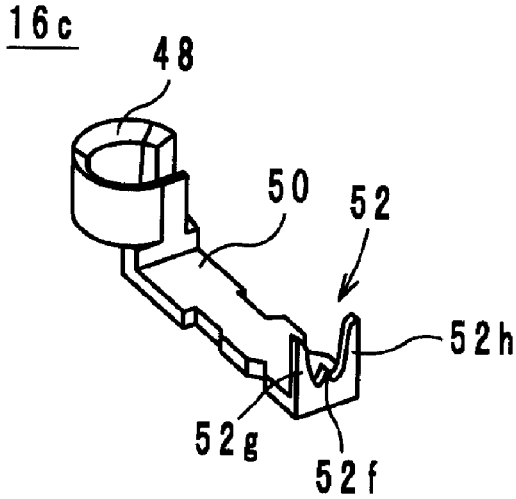

FIGS. 17A, 17B, and 17C are external perspective views of sockets 16*a*, 16*b*, and 16*c* according to first, second, and third modifications, respectively. In the case of the socket 16, the cutting pieces 52*a* and 52*b* cut the insulating film 223. However, a method for breaking the insulating film 223 is not limited thereto. For example, the socket 16*a* shown in FIG. 17A has the attaching portion including pointed projections 52*c* and 52*d* extending perpendicular to the longitudinal direction of the coaxial cable 220. The projections 52*c* and 52*d* penetrate the insulating film 223, break through the insulating film 223 so as to be connected to the center conductor 224.

The socket 16*b* shown in FIG. 17B has the attaching portion 52 including a substantially triangular cutting piece 52*e*. The cutting piece 52*e* is pointed so that the cutting piece 52*e* can penetrate the insulating film 223 as the projections 52*c* and 52*d* do, break through the insulating film 223, and be connected to the center conductor 224.

The socket 16*c* as shown in FIG. 17C, the attaching portion 52 includes cutting pieces 52*f*, 52*g*, and 52*h*. The cutting piece 52*f* has a substantially triangular shape as the cutting piece 52*e*. Thus, the cutting piece 52*f* can penetrate the insulating film 223, break through the insulating film 223, and be connected to the center conductor 224. The cutting pieces 52*g* and 52*h* are disposed with the cutting piece 52*f* therebetween. The distance between the cutting pieces 52*g* and 52*h* is smaller than the diameter of the insulating film 223. Thus, the cutting pieces 52*g* and 52*h* cut the insulating film 223 on both sides of the center conductor 224 in a Y-direction and accordingly pinch the center conductor 224 from both sides. Therefore, the center conductor 224 is connected to the socket 16*c* from three directions, whereby the center conductor 224 is more securely connected to the socket 16*c*.

Figure 18:
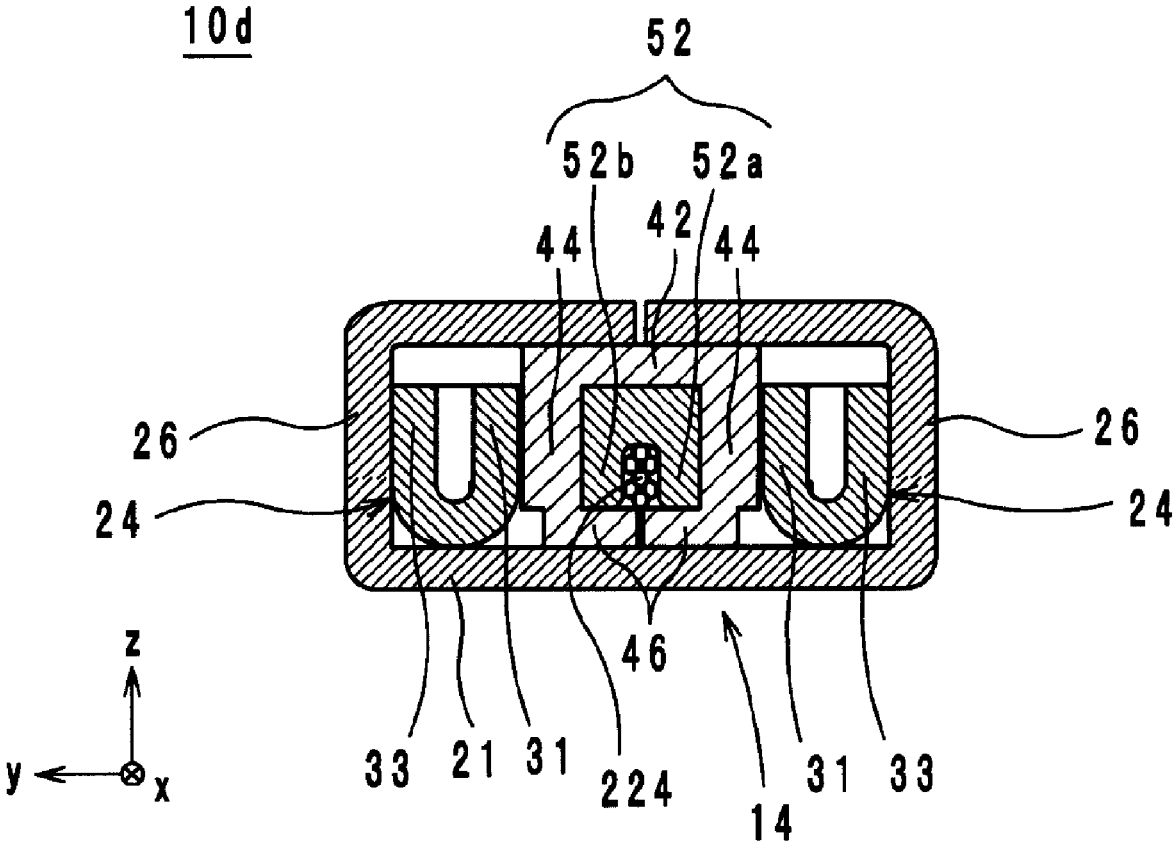
FIG. 18 is a cross-sectional structural view of the L-shaped coaxial connector according to a modification.

As shown in FIG. 8, with the L-shaped coaxial connector 10, the direction in which the crimping portions 26 are open and the direction in which the lid portions 46 are open are the same, which is the positive Z-direction. However, it is not necessary that these directions be the same, and may be differed by substantially 180 degrees. Specifically, as shown in a FIG. 18, which is a cross-sectional view of an L-shaped coaxial connector 10*d* according to a modification, the crimping portions 26 may be open in the positive Z-direction, and the lid portions 46 may be open to the negative Z-direction.

As shown in FIG. 2, the two lid portions 46 of the L-shaped coaxial connector 10 have a double-door structure. However, for example, only one lid portion 46 may be provided, and may have a single-door structure.

While preferred embodiments of the invention have been described above, it is to be understood that variations and modifications will be apparent to those skilled in the art without departing from the scope and spirit of the invention. The scope of the invention, therefore, is to be determined solely by the following claims.

What is claimed is:

1. An L-shaped coaxial connector connectable to and disconnectable from a receptacle having a first center conductor and an external conductor, the L-shaped coaxial connector being attachable to a coaxial cable having an outer conductor and a second center conductor that are insulated from each other through an insulating film disposed therebetween, the L-shaped coaxial connector comprising:

a housing adapted to contact the external conductor and connect to the outer conductor;

a bushing attached to the housing; and a socket attached to the bushing and insulated from the housing by the bushing, the socket adapted to contact the first center conductor, wherein the housing includes a crimping portion bendable into pressed contact with the bushing, in a state in which a part of the bushing is exposed, the bushing being pressable into contact with the insulating film with a force applied from the crimping portion, and wherein the socket includes an attaching portion being pressable into contact with the insulating film with a force applied from the bushing, the attaching portion adapted to pierce the insulating film to connect to the second center conductor of the coaxial cable.

2. The L-shaped coaxial connector according to claim 1, wherein the bushing further includes a lid portion adapted to be in pressed contact with the insulating film when the lid portion is in a bent position, in a state in which uncrimped part of the coaxial cable is exposed, and wherein the crimping portion, when in a bent position, is in pressed contact with the lid portion.

3. The L-shaped coaxial connector according to claim 1, wherein the attaching portion includes two cutting pieces disposed with a predetermined gap therebetween, wherein the cutting pieces are adapted to cut the insulating film of the coaxial cable, and wherein the second center conductor is disposed in the predetermined gap.

4. The L-shaped coaxial connector according to claim 1, wherein the attaching portion includes a pointed projection, the attaching portion adapted to break the insulating film to connect to the second center conductor.

5. The L-shaped coaxial connector according to claim 1, wherein the housing includes a cylinder portion having a first opening and a second opening, the cylinder portion being in contact with the external conductor inserted through the first opening, and a back portion connected to the cylinder portion and covering the second opening, wherein the housing is made of a metal plate, wherein the diameter of a part of the bushing contained in the cylinder portion is equal to or smaller than the diameter of the first opening, and wherein the crimping portion extends from the back portion and fixes the bushing to the housing by being bent to face the back portion with the bushing therebetween.

6. The L-shaped coaxial connector according to claim 5, wherein the housing further includes a holding mechanism adapted to allow the back portion to cover the second opening even when the crimping portion is not bent.

7. The L-shaped coaxial connector according to claim 6, wherein the housing further includes a fastening portion connected to the cylinder portion and disposed adjacent to the bushing on the back portion, wherein the crimping portion is bendable to face the back portion with the bushing and the fastening portion therebetween, and wherein the holding mechanism includes a first protruding portion and a second recessed portion, the recess portion being engageable with the first protruding portion, the first protruding portion being disposed on one of the crimping portion and the fastening portion, the second recessed portion being disposed on the other of the crimping portion and the fastening portion.

8. The L-shaped coaxial connector according to claim 5, wherein, a direction extending from the second opening to the first opening being a first direction, the bushing is exposed in the first direction from the housing in a state in which the crimping portion is not bent.

9. The L-shaped coaxial connector according to claim 5, wherein the bushing further includes a second protruding portion extending from the center of the part of the bushing contained in the cylinder portion, and wherein the second protruding portion is insertable into a recessed portion formed in an inner periphery of the cylinder portion.

10. The L-shaped coaxial connector according to claim 5, wherein the housing further includes a third protruding portion protruding inward in the first opening of the cylinder portion.

11. A method of manufacturing the L-shaped coaxial connector, the L-shaped coaxial connector being connectable to and disconnectable from a receptacle having a first center conductor and an external conductor, and wherein the L-shaped coaxial connector being attachable to a coaxial cable having an outer conductor and a second center conductor that are insulated from each other through an insulating film disposed therebetween, the method comprising:

providing a housing adapted to contact the external conductor and connect to the outer conductor;

providing a bushing adapted to be attached to the housing;

providing a socket adapted to be attached to the bushing and to be insulated from the housing by the bushing, the socket adapted to contact the first center conductor, wherein providing the housing includes providing a crimping portion bendable into pressed contact with the bushing, in a state in which a part of the bushing is exposed, the bushing being pressable into contact with the insulating film with a force applied from the crimping portion, and wherein providing the socket includes providing an attaching portion being pressable into contact with the insulating film with a force applied from the bushing, the attaching portion adapted to pierce the insulating film to connect to the second center conductor of the coaxial cable, attaching the bushing to the housing;

attaching the socket to the bushing;

placing the coaxial cable on the attaching portion; and connecting the attaching portion to the second center conductor by bending the crimping portion, while leaving a part of the bushing exposed.

12. The method of manufacturing the L-shaped coaxial connector according to claim 11, wherein providing the bushing further includes providing a lid portion adapted to be in pressed contact with the insulating film when the lid portion is in a bent position, in a state in which a part of the coaxial cable is exposed, and wherein the crimping portion, when in a bent position, is in pressed contact with the lid portion.

13. The method of manufacturing the L-shaped coaxial connector according to claim 11, wherein providing the attaching portion includes providing two cutting pieces disposed with a predetermined gap therebetween, wherein the cutting pieces are adapted to cut the insulating film of the coaxial cable, and wherein the second center conductor is disposed in the predetermined gap.

14. The method of manufacturing the L-shaped coaxial connector according to claim 11, wherein providing the attaching portion includes providing a pointed projection, the attaching portion adapted to break the insulating film to connect to the second center conductor.

15. The method of manufacturing the L-shaped coaxial connector according to claim 11, wherein providing the housing includes providing a cylinder portion having a first opening and a second opening, the cylinder portion being in contact with the external conductor inserted through the first opening, and a back portion connected to the cylinder portion and covering the second opening, wherein the housing is made of a metal plate, wherein the diameter of a part of the bushing contained in the cylinder portion is equal to or smaller than the diameter of the first opening, and wherein the crimping portion extends from the back portion and fixes the bushing to the housing by being bent to face the back portion with the bushing therebetween.

16. The method of manufacturing the L-shaped coaxial connector according to claim 15, wherein providing the housing further includes providing a holding mechanism adapted to allow the back portion to cover the second opening even when the crimping portion is not bent.

17. The method of manufacturing the L-shaped coaxial connector according to claim 16, wherein providing the housing further includes providing a fastening portion connected to the cylinder portion and disposed adjacent to the bushing on the back portion, wherein the crimping portion is bendable so as to face the back portion with the bushing and the fastening portion therebetween, and wherein providing the holding mechanism includes providing a first protruding portion and a second recessed portion, the second recess portion being engageable with the first protruding portion, the first protruding portion being disposed on one of the crimping portion and the fastening portion, the second recessed portion being disposed on the other of the crimping portion and the fastening portion.

18. The method of manufacturing the L-shaped coaxial connector according to claim 15, wherein, a direction extending from the second opening to the first opening being a first direction, the bushing is exposed in the first direction from the housing in a state in which the crimping portion is not bent.

19. The method of manufacturing the L-shaped coaxial connector according to claim 15, wherein providing the bushing further includes providing a second protruding portion extending from the center of the part of the bushing contained in the cylinder portion, and wherein the second protruding portion is insertable into a recessed portion formed in an inner periphery of the cylinder portion.

20. The method of manufacturing the L-shaped coaxial connector according to claim 15, wherein providing the housing further includes a third protruding portion protruding inward in the first opening of the cylinder portion.

* * * * *